United States Patent [19]

Vander Jagt

[11] Patent Number: 4,828,006

[45] Date of Patent: May 9, 1989

[54] LOST FOAM POUR BOX AND LOST FOAM CASTING PROCESS

[76] Inventor: A. Dean Vander Jagt, P.O. Box 190, Bay City, Mich. 48707

[21] Appl. No.: 107,649

[22] Filed: Oct. 13, 1987

[51] Int. Cl.[4] ..... B22C 9/04

[52] U.S. Cl. ..... 164/34; 164/61; 164/255; 164/410; 164/237

[58] Field of Search ..... 164/7.1, 7.2, 34, 35, 164/61, 63, 65, 160.1, 160.2, 246, 253, 255, 410, 237

[56] References Cited

U.S. PATENT DOCUMENTS

| | | | |
|---|---|---|---|
| 2,636,230 | 4/1953 | Morton | 164/202 |
| 3,557,867 | 1/1971 | Krzyzanowski | 164/7.1 |
| 3,861,447 | 1/1975 | Hondo | 164/34 |
| 4,318,437 | 3/1982 | Kemp | 164/34 |

FOREIGN PATENT DOCUMENTS

| | | | |
|---|---|---|---|
| 2523008 | 9/1983 | France | 164/34 |
| 6037245 | 2/1985 | Japan | 164/34 |

*Primary Examiner*—Richard K. Seidel
*Attorney, Agent, or Firm*—Edward E. Schilling; Timothy S. Stevens

[57] ABSTRACT

An improved lost foam pour box and lost foam casting process wherein the improvements are positioning one or more fluid permeable separators, such as well points, within the contained volume of the box so that the gasses generated in the lost foam casting process can be vented to the exterior of the box by passing through the separators. By positioning the separators within the box, a larger box can be used and more castings can be made within with reduced burn-in and porosity defects in the resulting castings.

16 Claims, 3 Drawing Sheets

LOST FOAM POUR BOX AND LOST FOAM CASTING PROCESS

FIELD OF THE INVENTION

The invention is in the field of casting apparatus and processes and is more specifically directed to improvements in apparatus and processes for lost foam casting.

BACKGROUND OF THE INVENTION

U.S. Pat. No. 3,557,867 (herein fully incorporated by reference) describes an innovative casting system known in the casting art as the "lost foam casting process". In the lost foam casting process a polymer foam, e.g., STYRAFOAM brand foamed polystyrene, "casting form" is positioned in a container called a "pour box" and surrounded by a gas permeable bed of heat resistant granular material. In practice, sand is believed to be almost always used and typically is specially selected and treated for this process. The "pour box" is a substantially upright, substantially open top container defining a contained volume. The container may have a porous sidewall or sidewall portion and/or a porous bottom wall or bottom wall portion. A generally tubular "casting means" is positioned to extend into the container so that one end of the casting means opens to and contacts the casting form. The casting means is positioned generally vertically and functions not unlike a funnel in directing molten metal to the casting form. Sand is then added to surround the casting means. The sand is then generally vibrated to pack it tightly around the casting form and to hopefully interlock the sand granules and keep them in position during the casting step itself. When molten metal is poured into the casting means it quickly flows down and displaces the polymer foam casting form. The molten metal heats the casting form, causing it to decompose and in fact substantially converting it entirely to gases that are vented through the sand and then out the top and through the porous sections of the side wall and bottom wall of the pour box. The molten metal promptly fills the space occupied by the casting form as the form decomposes and disappears. When the molten metal cools and hardens the casting should have precisely the shape of the casting form having attached thereto a "gate" formed by a little excess metal remaining in the casting means. The gate is generally subsequently removed from the solidified casting.

The lost foam casting process represents a significant advance in the art of casting metals and allows casting to close tolerances not unlike die casting and also allows casting of intricate shapes that are difficult or impossible to die cast. However this process is still in need of improvement in at least one regard. In the event that the gases produced can not escape through the sand rapidly enough, then the back pressure often will cause defects such as unsound portions in the casting and may even expel molten metal back up the casting means leaving undesired void spaces in the resulting casting or an incompletely filled form.

One means of addressing this problem that has been attempted is to utilize a pour box having partially or entirely porous walls and bottom and to apply a partial vacuum to the exterior thereof during casting. However, applying a partial vacuum like this can cause "burn-in" on the casting for those areas of the casting form that are nearest the walls and bottom of the pour box. Burn-in is the condition wherein molten metal moves beyond the space filled by the casting form and penetrates appreciably into the surrounding sand. Even when a vacuum strong enough to cause burn-in is applied, portions of the casting form farthest from the walls and bottom of the pour box can still generate deleterious back pressure as the polymer foam decomposes thermally.

SUMMARY OF THE INVENTION

The invention in one embodiment is an improved lost foam pour box of the type constituting a substantially upright, substantially open top container, usually cylindrical, defining a contained volume, the container having a sidewall and a bottom wall, the sidewall completly encompassing the perimeter of the bottom wall. The improved pour box is provided with at least one enclosed hollow fluid/solid separator, such as a well point, positioned within the contained volume and not contiguous to the sidewall of the container. The at least one enclosed hollow fluid/solid separator element has a fluid permeable portion forming at least a part of the enclosure, the fluid permeable portion having a face exposed to the contained volume and an enclosed face. Each separator element is vented or evacuated by a conduit means, such as a pipe, operatively connected to the outlet thereof, defining a flow channel between the enclosed face of the separator element and the exterior of the container.

The invention in another embodiment is an improved lost foam pour box of the type constituting a substantially open top container defining a contained volume, the container having a sidewall and a bottom wall. The improvement comprises providing at least one perforation through the bottom wall adapted to receive means for positioning at least one fluid/solid separator element fully within the contained volume of the pour box and not contiguous to the side wall. The means for positioning the separator element can be, for example, a pipe flange mounted on the bottom wall and aligned with a perforation or simply that a perforation is tapped to receive a pipe or conduit to be connected to the separator element to provide a flow channel to the exterior of the pour box. When multiple separator elements are employed it is preferred to join the conduits outside the pour box into a manifold and even more preferable is to discharge the conduits into a plenum formed partly or entirely in conjunction with the bottom wall of the container, the plenum of manifold being vented, e.g., to the atmosphere, but preferably by partial vacuum means such as a mechanical vacuum pump or a venturi vacuum pump to achieve a reduced pressure within the fluid/solid separator.

The invention is yet another embodiment is an improvement in lost foam casting process comprising the steps of: (a) placing a polymer foam casting form in a pour box having the form of a substantially upright container having a sidewall and a bottom wall; (b) placing a generally tubular casting means partially within the pour box so that one end of the casting means contacts, i.e., communicates with, the casting form; (c) surrounding the casting form and an adjacent portion of the casting means with a packed gas permeable bed of heat resistant granular material; (d) pouring molten metal into the other end of the casting means so that the molten metal runs down the casting means and contacts the casting form causing it to transform into the gaseous state thereby allowing the molten metal to occupy substantially the same space as the casting form; (e) venting the so-formed gases through the bed and away from the casting form, at least sufficiently to allow the molten metal to entirely replace the casting form; and, (f) allowing the molten metal to cool and solidify in the void in the gas permeable bed that had been occupied by the shape of the casting form; the improvement comprising that the step of venting the so-formed gases through the gas permeable bed is aided by at least one fluid/solid separator element, a well point for example, positioned within the bed and not contiguous to the sidewall of the container and conduit means communicatively connected to the fluid/solid separator element, directing vented so-formed gas to the exterior of the pour box.

DETAILED DESCRIPTION OF THE INVENTION

Figure 1:
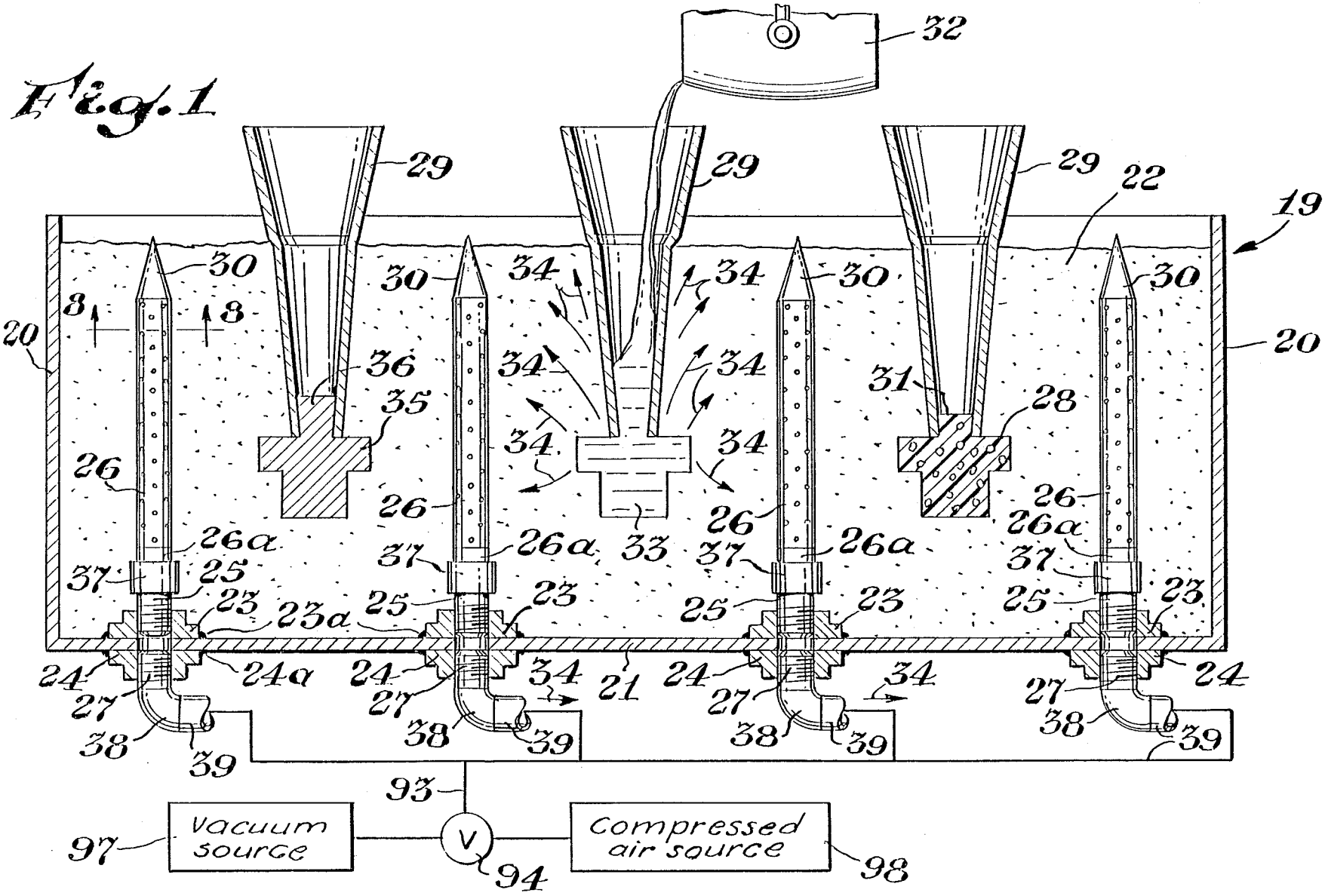
FIG. 1 is a side view mostly in section, partly in full and partly diagrammatic, illustrating one embodiment of the apparatus of the invention and showing the process of the invention at different successive stages.

Refering now to FIG. 1, therein is shown a lost foam pour box indicated generally by the numeral 19 having a sidewall 20 and a bottom wall 21. The sidewall 20 and the bottom wall 21 define a contained volume substantially filled with a heat resistant granular material 22, such as sand. The bottom wall 21 is shown perforated in four places, and on the inside of the bottom wall 21 at each perforation is mounted an interior pipe flange 23, shown welded to the bottom wall 21 by welds 23a, and on the outside of the bottom wall at each perforation is mounted an exterior pipe flange 24, shown welded to the bottom wall 21 by welds 24*a*. Alternatively, the pipe flanges 23 and 24 may be bolted or otherwise attached to the bottom wall 21. A pipe nipple 25 is threadably attached to each interior pipe flange 23. A well point 26 is attached to each pipe nipple 25 by a pipe union 37. A section of pipe 27 is attached to each exterior pipe flange 24. A pipe fitting elbow 38 is welded to each pipe 27 and another section of pipe 39 is welded to the each respective pipe elbow 38. The pipe 27, the elbow 38 and the pipe 39 serve as an exhaust pipe assembly normally leading to manifold 93, a three way valve 94, and a source of partial vacuum 97, to aid in venting the bed of granular material 22 surrounding the casting form, and a source of compressed air 98 to aid in fluidizing the bed of granular material 22 as will be discussed in greater detail below.

Figure 8:
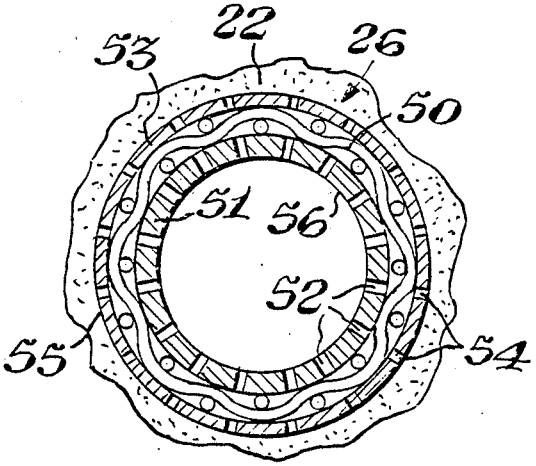
FIG. 8 is a greatly enlarged fragmentary view in section showing mainly a well point taken along the line 8—8 of FIG. 1 showing an outer layer of perforated metal sheeting covering a metal screen which is in turn wrapped on a perforated metal pipe.

Referring now to FIG. 8, therein is shown an enlarged fragmentary cross-sectional view of one of the well points 26 of FIG. 1 that serve as a fluid/solid separator surrounded by the granular material 22. In FIG. 8, a wire screen 50 is shown wrapped on a perforated or foraminous pipe 51. The pipe 51 contains a plurality of holes 52 therethrough. A sturdy perforated metal foil overwrap 53 is used to protect the screen 50 and contains a number of perforations 54. Referring again to FIG. 1, the wellpoint 26 should be understood to be a commercially available, suitable fluid/solid separator device generally having a sturdy, impervious nose cone 30 at its distal end, though such is not needed here but merely a closure, and an unperforated terminally externally threaded pipe portion 26*a* at the other, joined, end. In its normal intended use, a wellpoint is designed to be driven into the ground with one or more sections of pipe linearly joined to the open end 26*a* thereof as by a pipe union 37 and when the wellpoint is driven nose cone first into water saturated ground, the wellpoint acts as a fluid/solid separator and allows water relatively free of solids to flow back up the inside of the pipe sections. The wellpoint 26 is a hollow enclosure that has two faces, a first or exterior face 55 which is exposed to the contained volume of the pour box of FIG. 1, i.e., to the granular material 22 and any gases moving therethrough, and a second or interior face 56 which surrounds an interior channel, the hollow enclosure being integrally formed with an outlet line havign an open end or port which is connected to the interconnecting channel within the pipe nipple 25, the pipe flanges 23 and 24, and the exhaust pipe assembly of pipes 27 and 39, and elbow 38, the latter shown terminating outside the pour box. It should be understood that the casting forms 35 may take most any shape and are often connected by runners so that two or more casting forms in the container may be filled from one casting means. The runners may be formed of polymer foam or may each consist of a ceramic or other heat resistant material.

Figure 2:
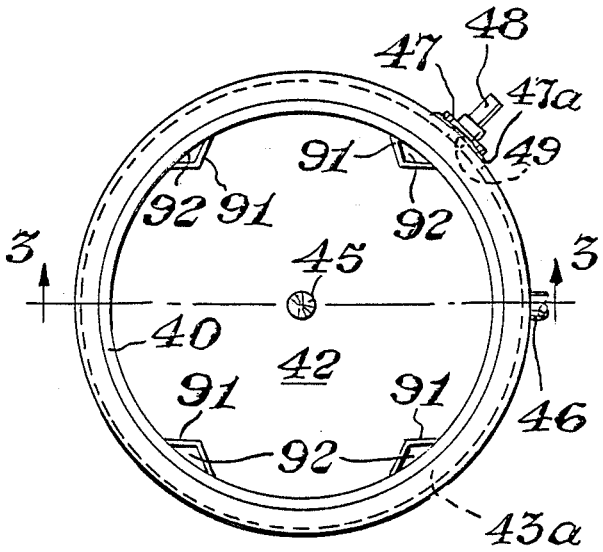
FIG. 2 is a top view of another embodiment of the apparatus of the inventoin with an annular section of the pour box wall being porous, with four porous upstanding angle shaped sections and there beig provided, in addition, one fluid/solid separator, in the form of a well point, connected to a conduit extending through a perforation through the bottom wall of the pour box.
Figure 3:
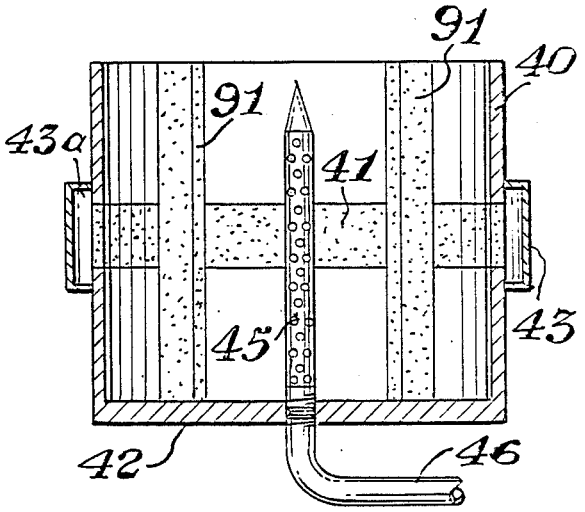
FIG. 3 is a side view mostly in section and partly in full of the apparatus embodiment shown in FIG. 2, taken along the line 3—3.

Referring now to FIGS. 2 and 3, there is shown a lost foam pour box having a cylindrical sidewall 40, incorporating a fluid porous mid-section or belt 41, four fluid-porous upstanding angle shaped sections 91 and a flat bottom wall 42. A length of U-shaped channel 43 has been bent into a circular form with edge flanges directed inwardly, the flanges being welded to the sidewall 40 straddling the porous mid-section 41, providing an enclosed annular space surrounding the porous midsection 41. The bottom wall 42 is centrally perforated and tapped from each side to accept standard pipe threads. An upwardly extending wellpoint 45 is screwed directly into the tapped central perforation from the upper side of the bottom wall 42. An exhaust pipe 46 is screwed into the tapped central perforation from the underside of the bottom wall 42. The exhaust pipe 46 leads to a suitable zone for venting at atmospheric pressure or to a source of partial vacuum.

Referring now to FIG. 2, therein is shown a pipe flange 47 secured to the exterior of the channel 43, by a weld 47*a*, over a perforation 49 therethrough and a pipe nipple 48 screwed into the pipe flange 47, together serving as a channel for exhausting or venting the annular space 43*a* of the container. Each angle shaped section 91 is closed at its upper end with a pie segment shaped insert 92. Preferably, the section 91 is formed of foraminous angle iron, e.g., angle iron which has been repeatedly drilled through and then covered with screen.

Figure 4:
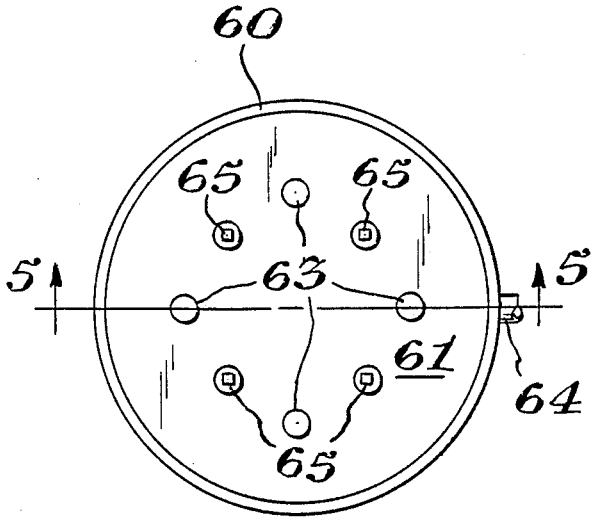
FIG. 4 is a top view of another embodiment of the apparatus of the invention showing several pleated fiberglass filter elements connected by respective conduits to perforations through the bottom wall of the pour box with a plurality of the perforations plugged.
Figure 5:
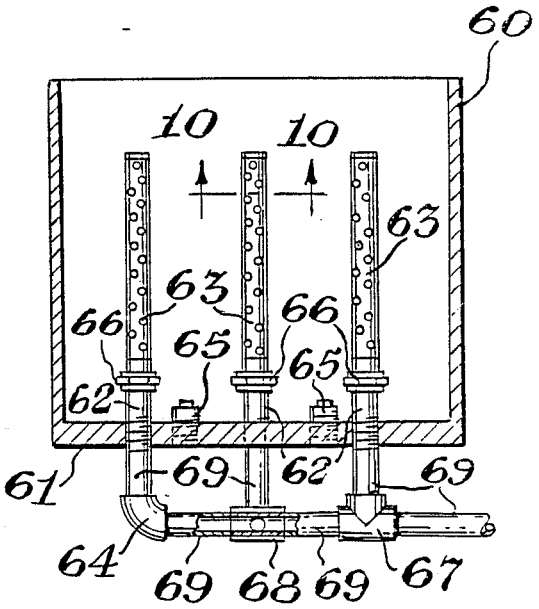
FIG. 5 is a side view mostly in sectionand partly in full of the apparatus of the embodiment shown in FIG. 4, taken along the line 5—5.

Referring now to FIGS. 4 and 5, therein is shown a lost foam pour box having a cylindrical sidewall 60 and a flat bottom wall 61. The bottom wall 61 is perforated therethrough in a number of locations and each perforation is tapped from each side to accept standard pipe threads. Pipe nipples 62 are shown screwed into four of the tapped perforations from the inside of the container. A pleated fiberglass felt filter separator element 63 is shown linearly joined to each pipe nipple 62 by a union 66. A manifold exhaust line assembly, composed of pipe fitting elbow 64, tee 67, cross 68 and pipe sections 69, is connected to each of the threaded perforations carrying a separator, from the outside of the container. Each perforation through the bottom wall 61 that does not have a pipe nipple communicating therethrough is closed by a pipe plug 65.

Referring more particularly to FIG. 4, therein is illustrated the pattern of an array of perforations in the bottom wall 61 and separator elements 63 corresponding to FIG. 5. The perforations not in use are plugged with pipe plugs 65.

Figure 10:
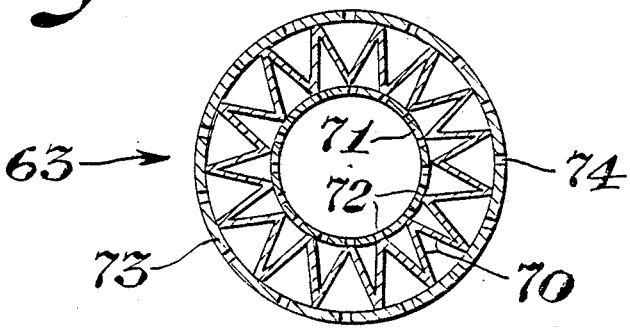
FIG. 10 is a greatly enlarged view in section of one of the filter elements of the embodiment shown in FIG. 5, the view being taken along the line 10—10.

Referring now to FIG. 10, therein is shown an enlarged cross-sectional view of one of the pleated fiberglass felt separator elements of FIG. 5. In FIG. 10, a sheet of pleated fiberglass felt 70 is shown arrayed around a perforated pipe 71. The pipe 71 contains a plurality of holes 72 therethrough. A sturdy perforated metal foil overwrap 73 is used to protect the felt 70 and contains a number of perforations 74. In FIG. 5, the pleated fiberglass filter elements 63 are each shown connected to respective perforations in the bottom wall 61 by way of a pipe nipple 62 and union 66. However, the use of pipe nipples and unions for this purpose is not critical to the invention and the outlet pipe portions of each separator element 63 can be connected directly to the respective perforations in the bottom wall 61 without the use of a pipe nipple 62 and union 66 in a manner like that shown in FIG. 3. Likewise, any of the fluid/solid separator elements used according to the present invention may be vented or exhausted through the bottom wall of the container by any suitable conduit means providing a continuous flow channel. For flexibility of use of a container-separator element combination for the casting of a variety of sizes and shapes of castings, it will be convenient to provide a number of tapped perforations in the bottom wall of the container as illustrated in FIGS. 4 and 5, or a larger number wherein the container is large. An array of separator elements is then selected to fit amongst and between the casting form or forms to be positioned in the container in locations not blocked by the casting form or forms. Perforations that are not selected to carry a separator element are conveniently closed with a threaded plug. When a different array is appropriate, then a different pattern of separator elements and plugs is employed and the exhaust manifold assembly is re-assembled accordingly.

Figure 6:
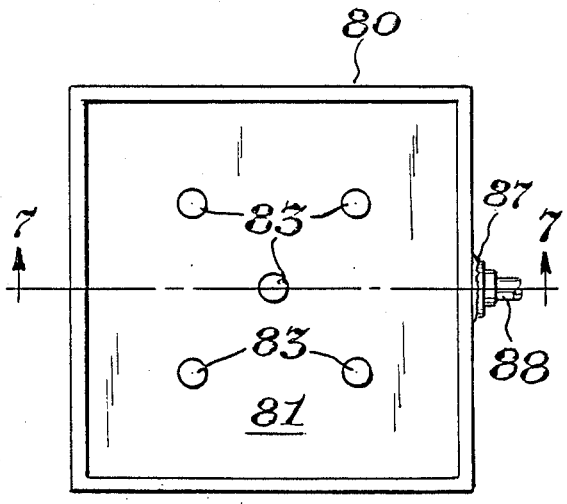
FIG. 6 is a top view of an embodiment of the apparatus of the invention having a plenum beneath the bottom wall of the pour box and having separator elements comprising sintered metal porous portions connected to the plenum by respective conduits extending through the bottom wall of the pour box.
Figure 7:
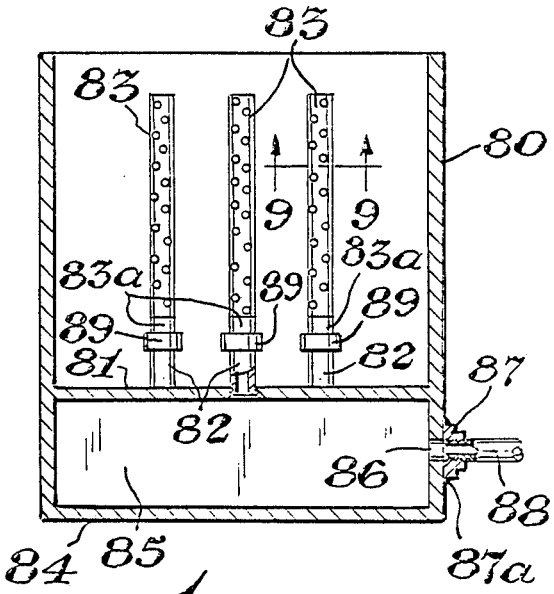
FIG. 7 is a side view mostly in section and party in full of the apparatus of the embodiment shown in FIG. 6, taken along the line 7—7.

Referring now to FIGS. 6 and 7, therein is shown a lost foam pour box having a sidewall 80 that is square in section, a flat bottom wall 81 and a lower bottom wall 84. A plenum 85 is formed by the bottom wall 81 of the container, the lower bottom wall 84 and an extension of the sidewall 80. Although not shown, the plenum 85 can be compartmented to strengthen the bottom wall 81 and to make the plenum more explosion resistant. The bottom wall 81 is perforated in several places and each perforation is tapped. A pipe nipple 82 is screwed into each tapped perforation from the inside of the container. Sintered metal filter elements 83 with pipe nipple portions 83*a* are linearly joined to the pipe nipples 82 by unions 89. In any such apparatus the separators may all be of the same type or mixed, as may be desired. A perforation 86 in the extended sidewall provides fluid communication with the plenum 85 and aligned with the perforation 86 is a pipe flange 87 attached to the sidewall 80 by a weld 87*a*. An exhaust pipe 88 is screwed into the pipe flange 87. Preferably, the lost foam pour box of the present invention has a plenum under the bottom wall as this design facilitates the positioning of numerous perforations through the bottom wall without the need for assembling and reassembling complex exhaust manifolds. The provision of numerous perforations through the bottom wall of the pour box allows a more optimized positioning of fluid/solid separator elements for a given casting job. Unused perforations through the bottom wall can be readily plugged as shown for example in FIGS. 4 and 5, by threaded plugs Referring more particularly to FIG. 6, therein is shown the square nature of the container and an array of separator elements that may be used.

Figure 9:
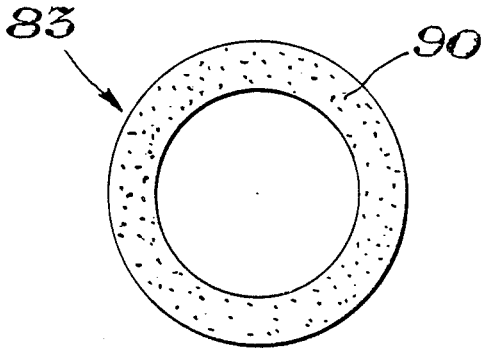
FIG. 9 is a greatly enlarged view in section of one of the filter elements of the embodiment shown in FIG. 7, the view being taken along the line 9—9.

Referring now to FIG. 9, therein is shown an enlarged cross-sectional view of the sintered metal filter element 83 of FIG. 7 that serve as one of the fluid/solid separators. In FIG. 9, the sintered metal particles 90 are seen as a group to form a tubular fluid-porous wall that serves as the fluid/solid separator portion of the separator element 83.

Three examples of hollow enclosed fluid/solid separators have been given and are the well point 26 of FIGS. 1, 2 and 8, the pleated fiberglass filter element 63 of FIGS. 5 and 10 and the sintered metal filter element 83 of FIGS. 7 and 9. All of these examples are of enclosed hollow fluid/solid separators having a separation element shaped in the form of an elongated tube, the side walls of which are sufficiently fluid porous to permit the requisite venting of gases from the decomposing casting form, and being provided at one end with a pipe threaded outlet pipe section, i.e., they are of the well point type. Most preferably, a well point type separator is directly screwed into a tapped perforation in the bottom wall of a pour box as shown in FIG. 3. Other separator elements may be employed with porous hollow globular or most any other hollow shape separator elements. Preferably, the fluid/solid separators of the present invention are conventional well points because it is believed that they provide the greatest economy, are rugged and are widely available in various solid retention grades (such as grades designed for use in sandy soil). The three examples also are of hollow enclosed fluid/solid separators positioned within the pour box so as to be not contiguous with the side wall of the box. It should be understood that the porous mid-section 41 and the porous angle section 91 shown in FIG. 3 are known and are not the improvement of the present invention, but the embodiment shown in FIG. 3 is an embodiment of the present invention because the well point 45 is positioned within the pour box and not contiguous with the wall 40 and may be used in conjunction with the porous mid-section and/or porous angle sections, although the latter are not necessary.

The prefered material of construction of the pour box of the present invention is steel although other sturdy, heat tolerant materials can be used. The prefered means of fabricating the prefered pour box of the present invention is by welding preformed shapes of steel together.

The improved process of the present invention will be better understood upon becoming familiar with the following description, reference being had to FIG. 1. The parts may be assembled by attaching the casting form 28 to the casting means 29. A projection 31 on the casting form 28 extends upwardly into and interlocks with the casting means 29 to hold them together while the casting form is being surrounded by the granular material 22 (e.g., sand). This can be done by immersing the casting form 28 and casting means 29 into a fluidized bed of sand fluidized by blowing air at an appropriate rate into the pipes 39 from the manifold 93. Alternatively, the casting form 28 and the casting means 29 may first be positioned in the pour box 19 and then the sand added. Preferably, the pour box 19 is then vibrated to settle and interlock the sand granules without leaving voids. A flask 32 of molten metal 33 is positioned over a casting means 29 as shown. The hot molten metal contacts the casting form causing it to gasify thereby allowing the molten metal 33 to occupy substantially the same space as the casting form once occupied. The gas generated flows through the bed of sand as depicted by the arrows 34, through the walls of the well points 26, through the pipe nipples 25, and then through the exhaust pipes 27 and 39. The molten metal cools and solidifies to form a casting 35. The excess metal used to form the casting 35 forms a gate 36. By placing at least one fluid/solid separator element 26 within the bed of granular material 22, the distance the gas produced needs to travel through the bed 22 can be significantly and critically reduced relative to prior known apparatus, especially for a relatively large pour box since gas permeation through porous media is exponentially reduced with the distance permeated due to the compressibility of a gas. In any event, the gases generated by decomposition of the casting form are more uniformly, efficiently and reliably removed using one or more of the separator elements of the invention. Frequently, it will be desirable to vent the gases to the partial vacuum source 97. It may even be desirable to place a fluid impermeable cover, usually flexible, overthe sand bed in the pour box, when venting to a partial vacuum, to maintain the interstitial space between the sand grains at a reduced pressure, and the cover can be weighted if desired to improve the dimensional stability of the casting form during vibration of the sand bed.

A suitable spacing and number of fluid/solid separators to use in any given container with a given casting form, or group of casting forms, is readily determined by one skilled in the art having reference to the foregoing description and the accompanying drawings. The fluid/solid separator, or separators, should each be sufficiently close enough to the casting form to relieve gas pressure through the sand bed, but when venting to a partial vacuum the spacing between the casting form and the fluid/solid separator should not be so close as to cause burn in nor the partial vacuum a sufficiently high vacuum to cause burn in with the array of fluid solid separators used.

What is claimed is

1. A lost foam pour box having a substantially upright, substantially open top container defining a contained volume, the container havig a sidewall and a bottom wall, the improvement which comprises:

a plurality of perforations extending through said bottom wall arrayed in a predetermined pattern;

positioned within the contained volume and not contiguous to the sidewall of the container, means for removing gases from a thermally decomposing polymer foam casting form, in the form of at least one removable enclosed hollow fluid/solid separator element having a fluid permeable portion forming at least a part of the enclosure, the fluid permeable portion having a face exposed to the contained volume and an enclosed face; and at least one conduit means having a first end in communication with the interior of an enclosed hollow fluid/solid separator element and a second end extending into and engaging one of said perforations, the at least one conduit means each extending upwardly from said bottom wall and being adapted to extend so as to support the at least one fluid/solid separator element in the vicinity of a polymer foam casting form when positioned within the container and defining a flow channel between the separator element and the exterior of the pour box;

the perforations being independently pluggable when the number of fluid/solid separator elements positioned within the container is less than the number of perforations.

2. The lost foam pour box of claim 1 having at least two fluid/solid separator elements and respective conduit means therefor.

3. The lost foam pour box as in claim 2 wherein the conduit means from each fluid/solid separator element extend through a respective perforation and are conjoined to form a manifold.

4. The lost foam pour box of claim 3 wherein at least four fluid/solid separator elements are mounted therein and the conduit means from substantially each fluid/solid separator element are conjoined to form a manifold.

5. The lost foam pour box of claim 3 wherein the conduit means each communicate through the bottom wall into a plenum substantially formed under the bottom wall, at least a portion of the bottom wall forming a part of said plenum.

6. The lost foam pour box of claim 2 wherein the container is substantially cylindrical.

7. The lost foam pour box of claim 1 wherein substantially each fluid/solid separator element is a foraminous pipe section closed at one end having outlet means at the other end joined to and communicating with said conduit means, the conduit means being a pipe nipple.

8. The lost foam pour box of claim 7 wherein substantially each fluid/solid separator element is a well point type.

9. The lost foam pour box of claim 1 having at least four perforations extending through the bottom wall of the container.

10. The lost foam pour box of claim 1 having at least five perforations extending through the bottom wall of the container.

11. The lost foam pour box of claim 1 in which the plurality of perforations are each tapped for receiving a second end of a conduit means or a removable plug.

12. A lost foam casting process comprising the steps of placing a polymer foam casting form in a gas permeable bed of heat resistant granular material contained in a pour box, which pour box is a substantially upright container, the container having a sidewall and a bottom wall; placing a generally tubular casting means, in the form of a down sprue, generally vertically and partially within the bed so that one end of the casting means communicates with the interior of the casting form; pouring molten metal into the other end of the casting form so that the molten metal runs down the casting means and contacts the casting form causing it to gasify thereby allowing the molten metal to occupy substantially the same space as the casting form; venting the so-formed gases through the gas permeable bed and away from the casting form; allowing the molten metal to cool and solidify substantially in the shape of the casting form, wherein the improvement comprises:

utilizing as the pour box a generally upright container having a plurality of independently pluggable perforations extending through the bottom wall thereof;

predetermining an advantageous array of said perforations based on the size and shape of the foam casting form;

venting the so-formed gases through at least one removable enclosed hollow fluid/solid separator element positioned fully within the bed and not contiguous to the sidewall of the container, each such separator element being vented to the exterior of the container by way of one of a plurality of said arrayed perforations in the bottom wall of the container; and closing any unused perforations with a removable plug prior to casting.

13. The process of claim 12 further comprising the step of then venting the so-formed gases from the removable enclosed separator element through a communicating conduit to the exterior of the container.

14. The process of claim 12 wherein the gases are vented through at least two removable fluid/solid separator elements.

15. The process of claim 12 wherein each at least one fluid/solid separator element utilized is of the well point type.

16. The process of claim 12 wherein venting is aided by connecting the at least one separator element to a partial vacuum while the molten metal is being poured and gasifying the casting form.

* * * * *